US006643492B1

(12) United States Patent
Kuga

(10) Patent No.: US 6,643,492 B1
(45) Date of Patent: Nov. 4, 2003

(54) IMAGE FORMING APPARATUS AND IMAGE FORMING METHOD

(75) Inventor: Masato Kuga, Kawasaki (JP)

(73) Assignees: Kabushiki Kaisha Toshiba, Kawasaki (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/310,926

(22) Filed: May 13, 1999

(30) Foreign Application Priority Data

May 13, 1998 (JP) ..... 10-130435

(51) Int. Cl.[7] ..... G03G 15/00; G03G 21/00
(52) U.S. Cl. ..... 399/402; 399/16; 399/38
(58) Field of Search ..... 399/16, 18, 19, 399/38, 401, 402

(56) References Cited

U.S. PATENT DOCUMENTS 4,437,756 A * 3/1984 Kawakubo et al. ..... 399/402
5,313,258 A * 5/1994 Nishi ..... 399/402
5,627,650 A 5/1997 Nosaki et al. ..... 358/296

FOREIGN PATENT DOCUMENTS

EP 0 281 096 A2 * 9/1988
JP 1-92134 * 4/1989
JP 7-5731 * 9/1995

* cited by examiner

*Primary Examiner*—Sophia S. Chen
(74) *Attorney, Agent, or Firm*—Foley & Lardner

(57) ABSTRACT

An image forming apparatus has a double-sided image forming mode. In this mode, a paper sheet is fed to a printer section to form an image on its first side and reversed through a reversing path of a reversing mechanism. The reversed paper sheet is stacked temporarily in a temporary stacking section and fed again to the printer section by a pickup roller to form an image on its second side. The paper sheet is then ejected. If there are no sufficient paper sheets in the stacking section before the double-sided image forming mode is completed, it is determined that an accident has occurred and the double-sided image forming mode is executed again. If a paper sheet remains in the stacking section after the double-sided image forming mode is completed, it is also determined that an accident has occurred and the double-sided image forming mode is executed again.

10 Claims, 7 Drawing Sheets

IMAGE FORMING APPARATUS AND IMAGE FORMING METHOD

BACKGROUND OF THE INVENTION

The present invention relates to an image forming apparatus and an image forming method and, more particularly, to an image forming apparatus such as a digital copying machine for temporarily storing image data corresponding to a document image and forming an image on a paper sheet based on the stored image data, and an image forming method applicable to the image forming apparatus.

A digital copying machine for optically reading a document image, creating image data corresponding to the document image, temporarily storing the image data, and forming an image on a paper sheet in predetermined timing based on the stored image data, has recently been put into practical use.

The digital copying machine comprises an automatic document feeding unit in which a plurality of original documents can be set, for feeding the set documents to a predetermined position of a document table in predetermined timing, a scanner section for reading an image of each of the documents located in the predetermined position of the document table and converting information of the image into image data, an image memory for temporarily storing the image data of the document image read by the scanner section, a paper feeding unit in which a plurality of paper sheets can be held as recording mediums, for feeding the paper sheets one by one, a printer section for forming an image on each of the paper sheets fed from the paper feeding unit based on the image data stored in the image memory, and a reversing mechanism including a stacking section for temporarily stacking the paper sheets each having an image formed on its one side, for reversing the paper sheets in predetermined timing and resupplying them to the printer section.

Of digital copying machines as described above, there is one having a double-sided image forming mode which is predicated on a so-called paper stack system in which an image is formed on a single side of each of paper sheets and such paper sheets are stored temporarily. In the double-sided image forming mode, an image is formed on one side of each of paper sheets supplied from the paper feeding unit based on image data stored in the image memory in the printer section, and these paper sheets are stacked in sequence in the stacking section. The stacked paper sheets are reversed in predetermined timing and supplied to the printer section again. An image is then formed on the other side of each of the paper sheets based on the image data, and these paper sheets are ejected.

The above double-sided image forming mode employing a paper stack system is a function peculiar to a digital copying machine and thus allows an image to be formed quickly on both sides of a paper sheet.

In the double-sided image forming mode, if a sheet with an image only on its one side remains in the stacking section of the reversing mechanism though all image data is output from the image memory to complete the double-sided image forming mode, there is a strong possibility that images are not formed in correct order on both sides of each paper sheet.

The above phenomenon occurs when two or more paper sheets are supplied together from the paper feeding unit to the printer section. For example, when two paper sheets are supplied at once, an image is formed on a single side of only one of them and then the two paper sheets are stacked in the stacking section of the reversing mechanism. Since, however, the number of the paper sheets is counted as one on the image forming apparatus side, one paper sheet still remains in the stacking section even the other paper sheet is resupplied from the stacking section to the printer section. Consequently, images are not formed on both sides of a paper sheet in correct order.

Similarly, there is a strong possibility that images will not be formed on both sides of a paper sheet in correct order even when no sufficient paper sheets remain in the stacking section of the reversing mechanism before the double-sided image forming mode is completed.

This phenomenon occurs when two or more paper sheets are resupplied from the stacking section to the printer section. Assume two paper sheets are stacked in the stacking section. If the two paper sheets are resupplied to the printer section at once, the stacking section is emptied when one image forming operation is completed. Consequently, images are not formed on both sides of a paper sheet in correct order.

In the foregoing image forming apparatus having a double-sided image forming mode employing a paper stack system, it is likely that images cannot be formed on both sides of a paper sheet in correct order when a paper sheet remains in the stacking section of the reversing mechanism after the double-sided image forming mode is completed or when the stacking section is emptied before the mode is completed. For this reason, the double-sided image forming mode causes a problem of low reliability though the mode is a function peculiar to an image forming apparatus, especially a digital copying machine.

BRIEF SUMMARY OF THE INVENTION

The present invention has been developed in order to resolve the above problem and its object is to provide an image forming apparatus capable of forming images on both sides of a recording medium in correct order and having a double-sided image forming mode with high reliability, and an image forming method applicable to the image forming apparatus.

According to a first aspect of the present invention, there is provided an image forming method comprising:

- forming an image on one side of each of a plurality of recording mediums based on image data edited in predetermined output order;
- temporarily stacking the plurality of recording mediums, each bearing the image on one side thereof, in a stacking section, the recording mediums being stacked in a reverse state;
- forming an image on another side of each of the recording mediums stacked in the reverse state based on the image data in predetermined timing, and then ejecting the recording mediums outside; and
- ejecting a recording medium remaining in the stacking section outside when all images corresponding to the image data have been formed on the plurality of recording mediums.

According to a second aspect of the present invention, there is provided an image forming method comprising:

- a first step of forming an image on one side of each of a plurality of recording mediums based on image data edited in predetermined output order, and temporarily stacking the plurality of recording mediums in a stacking section, the recording mediums being staked in a reverse state;

a second step of forming an image on another side of each of the recording mediums stacked in the reverse state based on the image data in predetermined timing, and ejecting the recording mediums outside; and a third step of executing the first step again in a case where no recording medium remains in the stacking section before all images corresponding to the image data are formed on the plurality of recording mediums.

According to a third aspect of the present invention, there is provided an image forming apparatus comprising:

image forming means for forming an image on a recording medium based on image data;

stacking means for temporarily stacking the recording medium in a reverse state, an image being formed on one side of the recording medium by the image forming means;

supplying means for supplying the recording medium stacked in the stacking means to the image forming means in predetermined timing;

sensing means for sensing whether the recording medium is present in the stacking means; and control means having a double-sided image forming mode in which the image forming means forms images corresponding to image data on first and second sides of each of a plurality of recording mediums, the control means executing the double-sided image forming mode once again in a case where the sensing means senses that no recording medium remains in the stacking means before all the images corresponding to the image data are formed on the recording mediums stacked in the stacking means in the double-sided image forming mode.

According to a fourth aspect of the present invention, there is provided an image forming apparatus comprising:

image formation means for forming an image on recording mediums based on image data;

stacking means for temporarily stacking the recording mediums, each bearing the image formed on one side thereof by the image formation means, the recording mediums being stacked in a reverse state;

supplying means for supplying the recording mediums stacked in the stacking means to the image formation means in predetermined timing;

sensing means for sensing whether a recording medium is present in the stacking means;

ejecting means for ejecting the recording mediums outside; and control means having a double-sided image forming mode in which the image forming means forms images corresponding to image data on first and second sides of each of a plurality of recording mediums, the control means controlling the ejecting means to eject a recording medium outside in a case where the sensing means senses that the recording medium is present in the stacking means when all images corresponding to the image data have been formed on the plurality of recording mediums stacked in the stacking means in the double-sided image forming mode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An image forming apparatus according to an embodiment of the present invention will now be described in detail with reference to the accompanying drawings, as will be an image forming method applicable to the image forming apparatus.

The image forming apparatus is constituted as an electrophotographic compound digital copying machine (hereinafter referred to as a copying machine 2) having a copying function of copying a document image, a facsimile function of transmitting/receiving image data through a communication line, and a printer function of printing an image corresponding to the image data supplied from an external device via an external interface.

Figure 1:
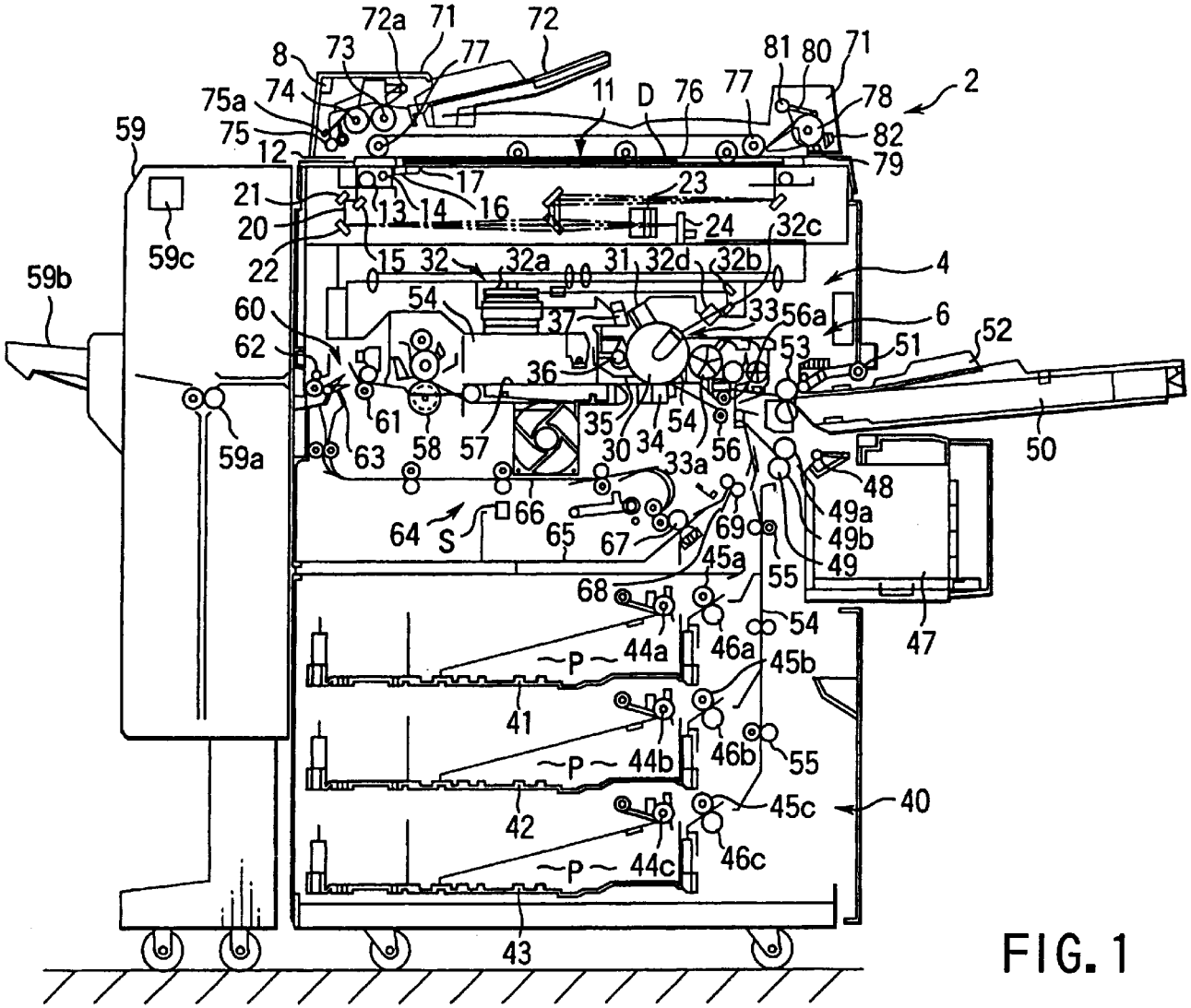
FIG. 1 is a cross-sectional view schematically showing a constitution of an image forming apparatus or a digital copying machine according to an embodiment of the present invention.

FIG. 1 is a cross-sectional view schematically showing an internal constitution of the copying machine 2.

As illustrated in FIG. 1, the copying machine 2 includes a scanner section 4 serving as a reading means for reading a document image to generate image data and a printer section 6 serving as an image forming means for forming an image based on the image data. The copying machine 2 also includes an automatic document feeding unit 8 serving as a document holder, which can be opened and closed above a document table 11 of the scanner section 4, for feeding original documents D, which are to be read, to the document table 11 one by one and for bringing the documents D into contact with the document table 11.

The document table 11 is provided opposite to the closed automatic document feeding unit 8 and formed of a transparent glass on which the documents D are placed. The scanner section 4 includes a document scale 12 arranged at one end of the document table 11 to indicate a position in which the documents D are to be set on the document table 11.

The scanner section 4 also includes an exposure lamp 13 located under the document table 11 to illuminate the documents D placed on the document table 11, an auxiliary reflector 14 for gathering light beams on the documents D from the exposure lamp 13, and a first mirror 15 for directing a beam reflected by the documents D toward the left-hand side of FIG. 1. The exposure lamp 13, auxiliary reflector 14 and first mirror 15 are fixed on a first carriage 16 and moved in parallel with the document table 11 as the first carriage 16 moves.

The copying machine 2 includes a second carriage on the left-hand side of the document table 11 in FIG. 1 or in which direction a beam is reflected and guided by the first mirror 15.

The second carriage 20 has a second mirror 21 arranged at right angles to the firs mirror 15 to direct the beam, which are reflected and guided by the first mirror 15, in the downward direction, and a third mirror 22 for directing the beam toward the right-hand side of FIG. 1. The second carriage 20 is driven in accordance with the first carriage 16 by a tooth belt (not shown) for driving the first carriage 16 and moved in parallel with the document table 11 at one half the speed of the first carriage 16.

An image forming lens 23 and a CCD image sensor 24 are provided under the first carriage 16 and within a plane including the optical axis of a beam turned through the second carriage 20. The image forming lens 23 forms an image from the beam reflected by the second carriage at a predetermined magnification. The CCD image sensor 24 converts the reflected beam, which is focused by the image forming lens 23, into an electrical signal or image data.

The printer section 6 includes a photosensitive drum 30 rotatably provided in nearly the central part of the copying machine 2. The photosensitive drum 30 is rotated at a predetermined rotational speed by a motor (not shown).

The printer section 6 also includes a charger 31 for charging the surface of the photosensitive drum 30 with predetermined charges, a laser exposure unit 32 for forming an electrostatic latent image on the surface of the drum 30, a developer unit 33 for developing the electrostatic latent image with a developer containing toner to form a toner image, a transfer/exfoliation charger 34 for transferring the toner image from the photosensitive drum 30 to copying paper P as a recording medium and exfoliating the copying paper P from the photosensitive drum 30, an exfoliation claw 35 for exfoliating the copying paper P from the surface of the photosensitive drum 30, a cleaner unit 36 for cleaning the toner remaining on the surface of the drum 30, and an eliminator unit 37 for eliminating a potential remaining on the surface of the drum 30, all of which are sequentially arranged in predetermined positions around the drum 30.

The laser exposure unit 32 includes a semiconductor laser device for emitting a laser beam modulated on the basis of image data, a light deflection device 32*a* for deflecting the laser beam, and image forming optical systems 32*b*, 32*c* and 32*d* for forming an image corresponding to the deflected laser beam on the photosensitive drum 30. The surface of the photosensitive drum 30, which is charged with a predetermined potential, is irradiated with a laser beam emitted from the semiconductor laser device to form an electrostatic latent image on the surface of the drum 30.

The developer unit 33 has a developer constituted of toner and carriers for frictionally charging the toner with a given polarity and forming a magnetic brush. The developer unit 33 also has a development roller 33*a* for supplying the developer onto the surface of the photosensitive drum 30 and attaching the toner to the electrostatic latent image to form an image in desired image concentrations.

A multistage paper feeding unit 40 having a plurality of stages and provided detachably from the front of the copying machine 2, is arranged under the photosensitive drum 30 and at the bottom of the copying machine 2.

The multistage paper feeding unit 40 includes an upper cassette 41, a middle cassette 42 and a lower cassette 43 for receiving a plurality of sheets of copying paper P having different sizes. These cassettes 41, 42 and 43 are capable of receiving about 500 A4-size paper sheets which are placed in their longitudinal direction, about 500 B4-size paper sheets and about 500 A3-size paper sheets, respectively.

Pickup rollers 44*a*, 44*b* and 44*c* are arranged in their respective positions of the upper, middle and lower cassettes 41, 42 and 43 to pick up paper sheets P one by one therefrom.

Paper supply rollers 45*a*, 45*b* and 45*c* and paper separation rollers 46*a*, 46*b* and 46*c* are arranged in which positions the leading edges of the paper sheets P removed from the cassettes 41, 42 and 43 by the pickup rollers 44*a*, 44*b* and 44*c* pass to supply and separate the paper sheets P one by one. These supply rollers 45*a*, 45*b* and 45*c* and separation rollers 46*a*, 46*b* and 46*c* are formed integrally with each other. The separation rollers 46*a*, 46*b* and 46*c* are so arranged that their axes are parallel with those of the supply rollers 45*a*, 45*b* and 45*c*, and they contact the supply rollers 45*a*, 45*b* and 45*c* at predetermined pressure and rotate in a direction opposite to that of rotation of the supply rollers 45*a*, 45*b* and 45*c*, with the result that only the uppermost one of the paper sheets P, removed from each of the cassettes, is sent out to a supply path which will be described later.

On the right-hand side of the multistage paper feeding unit 40 in FIG. 1, there is provided a large-capacity feeder 47 capable of holding paper sheets of a size with high frequency of use, e.g., about 3000 A4-size paper sheets P. A pickup roller 48 is provided in a given position of the large-capacity feeder 47 to pick up the paper sheets P from the feeder 47 one by one. A separation mechanism 49 including a supply roller 49*a* and a separation roller 49*b*, which are combined vertically into a paired component, is interposed between the pickup roller 48 and photosensitive drum 30. If the separation roller 49*b* is rotated in a direction opposite to that of the supply roller 49*a*, the separation mechanism 49 sends out only the uppermost one of paper sheets P, removed from the large-capacity feeder 47 by the pickup roller 48, to the supply path.

A manual feeder 50 capable of feeding copying paper sheets P is provided above the large-capacity feeder 47, independently of the cassettes 41, 42 and 43 and the feeder 47.

Between the manual feeder 50 and photosensitive drum 30, there are provided a pickup roller 51 for picking up the paper sheets P from the manual feeder 50, a guide 52 for guiding the paper sheets P picked up by the pickup roller 51, and a paper supply roller 53 for supplying the paper sheets P toward the photosensitive drum 30 through the guide 52.

A supply path 54 is formed between the photosensitive drum 30 and the cassettes 41, 42 and 43 and the large-capacity feeder 47 to guide the paper sheets P from the cassettes 41, 42 and 43 and feeder 47 to the photosensitive drum 30. The supply path 54 extends outside the copying machine 2 via a transfer region defined between the photosensitive drum 30 and transfer/exfoliation charger 34. The supply path 54 is provided with a plurality of paper supply rollers 55 for supplying the paper sheets P from each of the cassettes, the large-capacity feeder, or the guide to the photosensitive drum 30.

An aligning roller 56 is arranged on the supply path 54 in the vicinity of and on the upstream side of the photosensitive drum 30 to serve as a supply means for correcting an inclination of copying paper sheet P guided through the supply path 54, aligning a leading edge of a toner image on the photosensitive drum 30 with that of the paper sheet P, and supplying the paper sheet P to the transfer region at the same speed as that of the circumference of the drum 30. An aligning sensor 56*a* is provided before the aligning roller 56 or alongside the supply roller 55 to sense that the copying paper sheet P has reached the aligning roller 56.

A paper transfer belt 57 is formed in which direction a paper sheet P passes the transfer region and advances. A fixing unit 58 is provided in which direction the paper sheet P is transferred by the transfer belt 57 and in which position heat is hardly given to the photosensitive drum 30. The fixing unit 58 includes a pair of heat rollers the surfaces of which are pressed on each other, and the paper sheet P onto which a toner image is transferred is heated by the heat rollers to melt the toner image and fix the toner image on the paper sheet P.

A finisher 59, which serves as an ejection means for ejecting the paper sheet P on which the toner image is fixed by the fixing unit 58, is provided on the side wall of the copying machine 2 facing the fixing unit 58.

The finisher 59 includes a roller pair 59*a* for placing paper sheets P, which are ejected from an ejection roller 62, face down, an ejection tray 59*b* from which the paper sheets P are ejected by the roller pair 59*a*, and a stapler 59*c* for stapling the paper sheets P copy by copy in a staple sort mode.

An ejection selecting unit 60 for guiding a copying paper sheet P on which a toner image is fixed by the fixing unit 58, to one of the finisher 59 and paper reversing mechanism 64 (described later), is interposed between the fixing unit 58 and finisher 59.

The ejection selecting unit 60 includes first and second ejection rollers 61 and 62 for ejecting the paper sheets P which have passed the fixing unit 58, and a selection gate 63 interposed between the first and second ejection rollers 61 and 62 to selectively sending the paper sheets P to the finisher 59 and reversing mechanism 64.

The reversing mechanism 64 includes a temporary stacking section 65 for temporarily stacking copying paper sheets P which have passed both the transfer region and fixing unit 58, a reversing path 66 for reversing the paper sheets P which have passed the fixing unit 58 and guiding them to the temporary stacking section 65, a pickup roller 67 for picking up the paper sheets P from the stacking section 65 one by one, a supply path 68 for guiding the paper sheets P from the stacking section 65 to the aligning roller 56 again, a paper feeding roller 69 for feeding the paper sheets P to the aligning roller 56 through the supply path 68, and a sensor S serving as a sensing means for sensing whether a copying paper sheet P is present in the stacking section 65.

The automatic document feeding unit 8 includes a cover 71 whose trailing edge is attached to that of a top surface of the copying machine 2 by means of a hinge (not shown). The unit 8 is rotated and displaced when necessary and, as described above, it can be opened and closed above the document table 11 of the scanner section 4.

A document feeding table 72 capable of holding a predetermined number of documents D, e.g., fifty documents D, is provided on the rather left-hand side of the top surface of the cover 71. A pickup roller 73 is arranged on the left-hand side of the document feeding table 72 in FIG. 1 or at one end of the automatic document feeding unit 8 to pick up the documents D set on the table 72 one by one and then supply them from the left-hand side of FIG. 1 to one end of the document table 11.

An empty sensor 72*a* is disposed in a given position of the document feeding table 72 to function as a sensing means for sensing whether a document D is set on the table 72, as is a document position sensor 17 for sensing a position in which a document D is set on the document table 11. A document width sensor (not shown) having the same function as that of the sensor 17 can be arranged on the document feeding table 72.

A paper feeding roller 74 for feeding documents D picked up by the pickup roller 73 toward the document table 11 and an aligning roller 75 for aligning the leading edges of documents D fed by the paper feeding roller 74, are arranged in a document pickup direction of the pickup roller 73.

Between the aligning roller 75 and paper feeding roller 74, an aligning sensor 75*a* is provided to sense that a document D has reached the aligning roller 75.

A transfer belt 76 of such a size as to cover almost all the document table 11 is formed inside the cover 71 and in a position opposite to the document table 11 when the automatic document feeding unit 8 is closed. The transfer belt 76 transfers documents D from the document feeding table 72 to a predetermined position of the document table 11 through the pickup roller 73, paper feeding roller 74 and aligning roller 75. The transfer belt 76 is looped around a pair of belt rollers 77 arranged on the right- and left-hand sides of FIG. 1, and rotated in both directions of the right- and left-hand sides of FIG. 1 by a belt driving mechanism (not shown).

On the right-hand side of the automatic document feeding unit 8, there are provided a reversing roller 78 for sending a document D, which is moving from the left to the right in FIG. 1 by the transfer belt 76, outside the cover 71, a pinch roller 79 for pressing the document D on the reversing roller 78, a flapper 80 for determining whether to return the document D supplied by the reversing roller 78 and pinch roller 79 to the transfer belt 76 or eject it to a given ejecting position or onto the cover 71, an ejection roller 81 for ejecting the document D supplied by the reversing roller 78 when the flapper 80 is switched to the ejection side, and a jam sensor 82 for sensing a jam of documents near the reversing roller 78.

Figure 2:
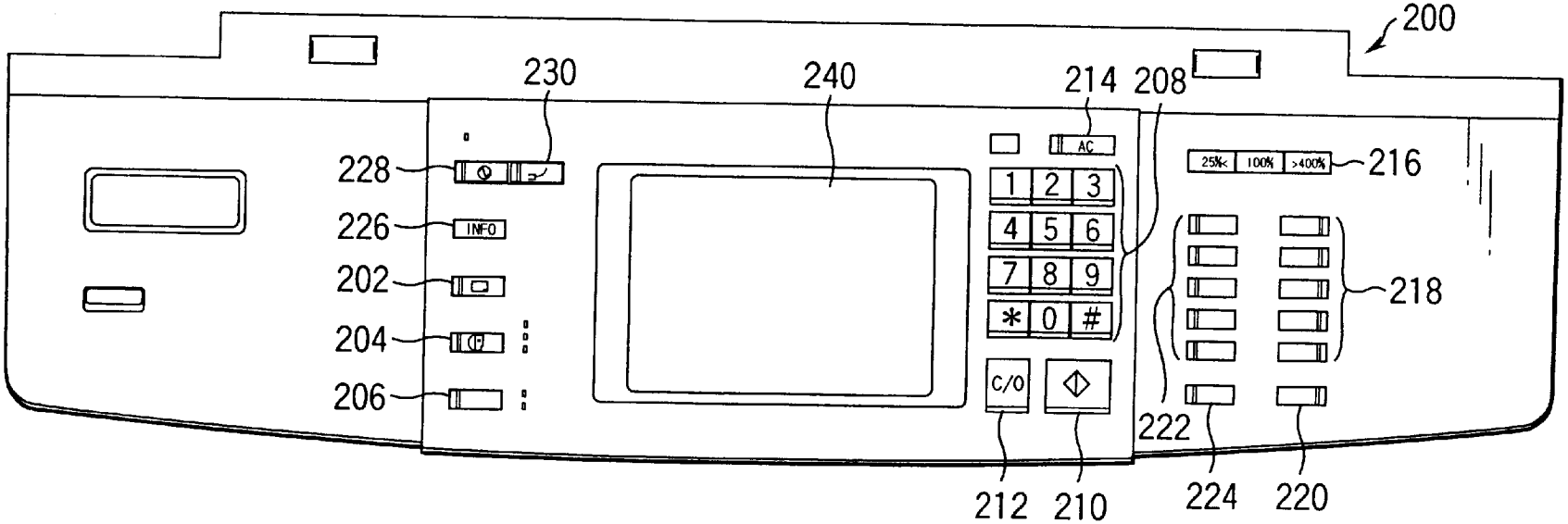
FIG. 2 is a schematic plan view of a control panel included in the image forming apparatus shown in FIG. 1.

FIG. 2 illustrates a control panel 200 provided on the upper front of the copying machine 2 and used to input various copying conditions and a copying start signal for starting copying operations.

Referring to FIG. 2, the control panel 200 includes a copy button 202 for setting a copy mode to fulfill a copying function, a FAX button 204 for setting a FAX mode to perform a facsimile function, and a printer button 206 for setting a printer mode to carry out a printer function.

The control panel 200 also includes a ten-digit keypad 208 for inputting numeric values such as the number of copies in the copy mode, a start button 210 for indicating the start of copying, a clear/stop button 212 for correcting the number of copies and stopping a copying operation, an all-clear button 214 for clearing all of selected modes and set conditions, and a magnification setting button 216 for setting a magnification for copying.

The start button 210 serves as an input means for indicating the start of reading of documents set on the document feeding table 72 and indicating the formation of an image corresponding to image data.

The control panel 200 also includes a paper size button 218 for setting the size of paper on which an image is to be formed, an automatic paper selecting button 220 for sensing the size of a document placed on the document table and automatically setting the size of paper, a document size button 222 for setting the size of a document, and an automatic magnification selecting button 224 for automatically setting a magnification for copying on the basis of the size of paper set by the paper size button 218 and the size of the document set by the document size button 222.

In addition to the above buttons, the control panel 200 includes an operation guide button 226 for displaying guide information such as the contents of a set mode and operating procedures, a preheat button 228 for setting a preheat state, and an interrupt button 230 for indicating an interrupt during the operation of the printer section.

The control panel 200 has in its nearly central part a display panel 240 constituted of a touch panel type liquid crystal display (LCD) serving as an informing means for informing a user of apparatus conditions, operating procedures and various messages in the form of letters and figures. This display panel 240 displays an operation of each of the functions on a display screen.

Figure 3:
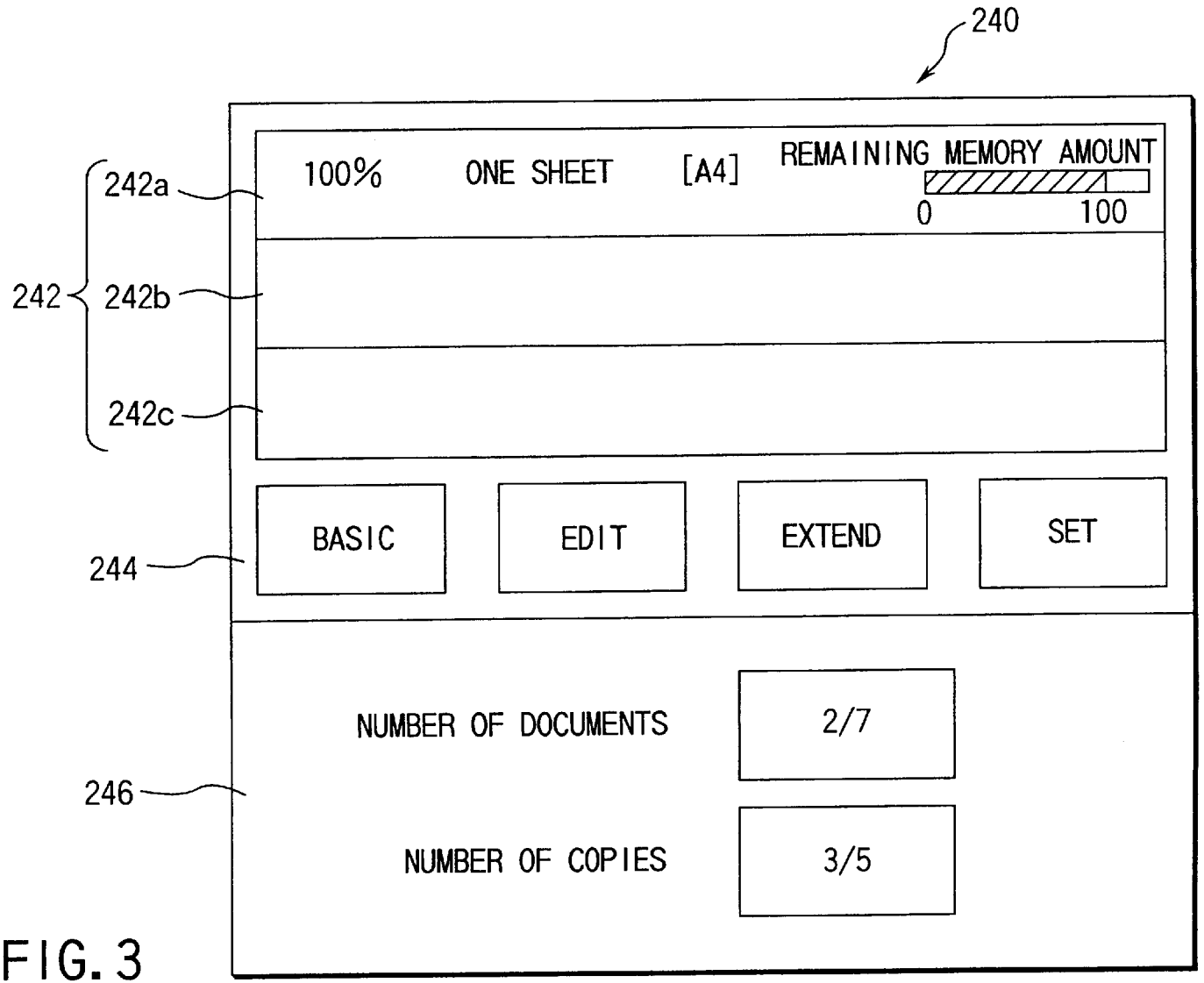
FIG. 3 is a plan view illustrating a constitution of a display panel of the control panel shown in FIG. 2.

As illustrated in FIG. 3, the display panel 240 includes a message area 242 having three areas of an upper area 242*a*, a middle area 242*b* and a lower area 242*c* for providing a user with information, a title area 244 in which title selection buttons are arranged, and a field area 246 for displaying an icon.

The upper area 242*a* of the message area 242 displays a magnification for copying, the number of copies, the size of paper, the remaining capacity of an image memory for temporarily storing the readout image data, and the like.

Figure 4:
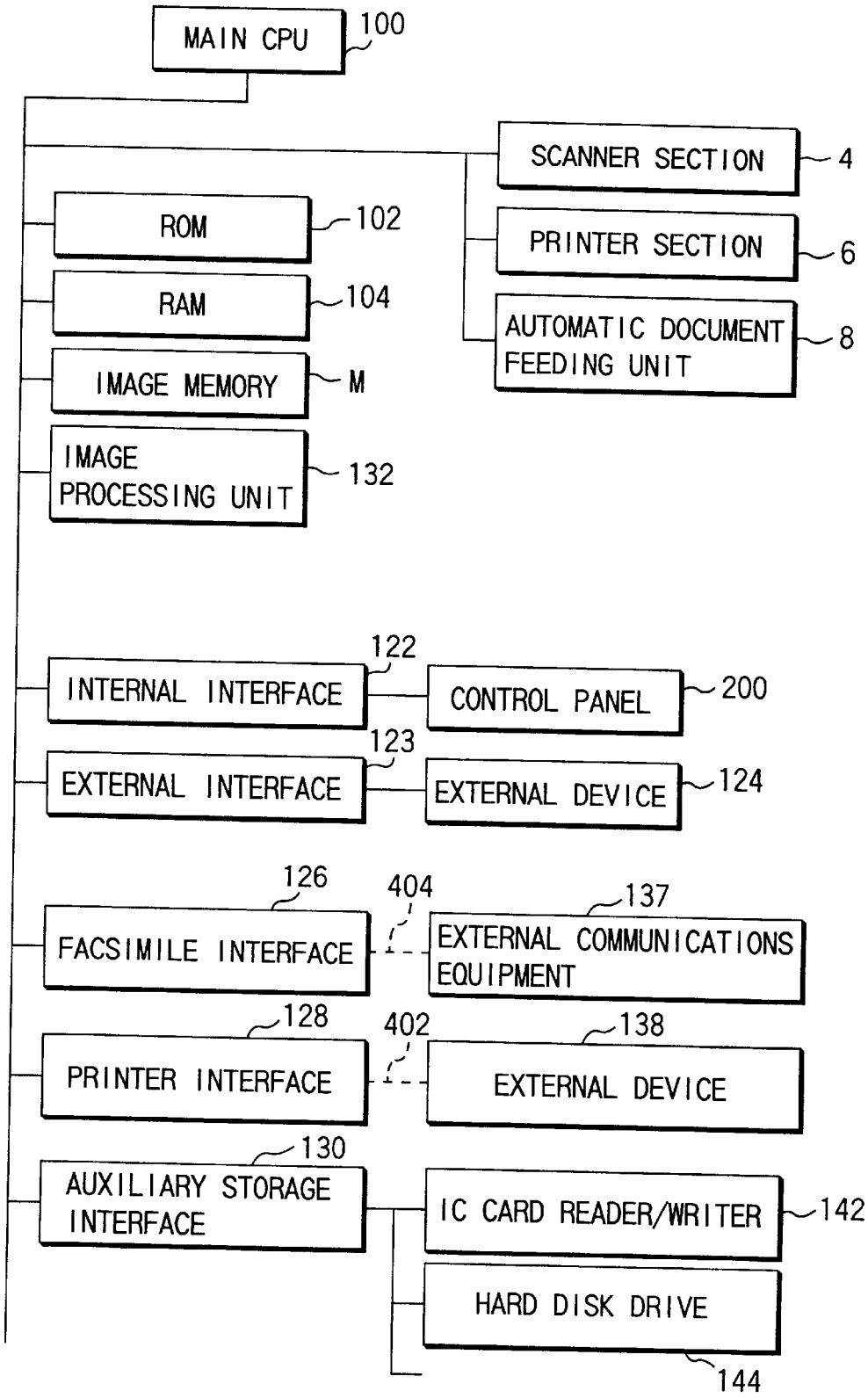
FIG. 4 is a block diagram schematically showing an arrangement of a control circuit of the image forming apparatus of FIG. 1.

FIG. 4 is a schematic view of the arrangement of a control circuit for controlling the digital copying machine 2 shown in FIG. 1 as an image forming apparatus.

Referring to FIG. 4, the copying machine 2 has a main CPU 100 serving as a control means for centralizing control of the entire copying machine. The main CPU 100 is connected to the scanner section 4, printer section 6 and document feeding unit 8 to control their driving operations. The CPU 100 processes image data supplied through the scanner section 4, printer cable 402 and telephone line 404 and outputs it to the printer section 6 as image data corresponding to an image to be formed on a paper sheet.

The main CPU 100 is also connected to a ROM 102, a RAM 104, an image memory M serving as a storage means, an internal interface 122, an external interface 123, a facsimile interface 126, a printer interface 128, an auxiliary storage interface 130, an image processing unit 132, and the like.

The control panel 200 as described with reference to FIG. 2, is connected to the internal interface 122. An external device 124 is connected to the external interface 123. An external communications equipment 137 such as an external facsimile is connected to the facsimile interface 126 via the telephone line 404. An external device 138 such as a personal computer is connected to the printer interface 128 via the printer cable 402. An IC card reader/writer 142 and a hard disk drive 144 are connected to the auxiliary storage interface 130.

The image memory M temporarily stores copy data as image data corresponding to a document image read by the scanner section 4, facsimile data as image data supplied from the external communications equipment 137 through the telephone line 404 and facsimile interface 126, and print data as image data supplied from the external device 138 through the printer cable 402 and printer interface 128.

The image processing unit 132 includes an image conversion circuit for enlarging and reducing binary image data, a compression/extension circuit for compressing and extending image data, and an editing section for editing various types of image data stored in the image memory M in predetermined output order.

The main CPU 100 has a printer function of controlling the image processing unit 132 and image memory M and processing print data supplied from the external device 138 via the printer cable 402 and printer interface 128 to convert the processed data into image data to be printed and edit the image data in the order of being output to the printer section 6 and then supplying the image data to the printer section 6 in predetermined timing. In this printer function, the image memory M temporarily stores the image data supplied from the external device 138.

The main CPU 100 has a facsimile function of controlling the image processing unit 132 and image memory M and processing facsimile data supplied through the telephone line 404 to convert the processed data into image data to be printed in the printer section 6, and processing document image data read by the scanner section 4, editing the image data in the order of being output to the printer section 6 and then supplying the image data to the printer section 6 in predetermined timing. In this facsimile function, the image memory M temporarily stores the facsimile data supplied through the telephone line 404 as received image data and image data scanned by the scanner section 4 as transmitted image data.

Furthermore, the main CPU has a copying function of controlling the image processing unit 132 and image memory M and processing document image data read by the scanner section 4, editing the image data in the order of being output to the printer section 6, and then supplying the image data to the printer section 6 in predetermined timing. In this copying function, the image memory M temporarily stores the image data supplied from the scanner section 4.

In the control circuit so constituted, when image data of a document is transmitted using the facsimile function, the main CPU 100 causes the image data scanned by the scanner section 4 to be stored in the image memory M. The stored image data is enlarged or reduced by the image conversion circuit of the image processing unit 132 in accordance with the size of paper of the receiving end (destination) when the need arises, and the size-converted image data is encoded by the compression/extension circuit of the image processing unit 132, and then the encoded data is transmitted to the external communications equipment of the receiving end via the facsimile interface 126 and telephone line 404.

When image data is received from outside using the facsimile function, image data supplied from the external communications equipment 137 of the transmitting end through the telephone line 404 and facsimile interface 126 is stored in the image memory M. The image data is thus decoded by the compression/extension circuit of the image processing unit 132 and then output to the printer section 6 in predetermined timing.

When a document image is copied using the copying function, the main CPU 100 causes image data of a document scanned by the scanner section 4 to be stored in the image memory M. The stored image data is processed by the image processing unit 132 and then supplied to the printer section 6 in predetermined timing.

When image data supplied from outside is output using the printer function, image data supplied from the external device 138 through the printer cable 402 and printer interface 128 is stored in the image memory M. The stored image data is output to the printer section 6 in predetermined timing.

The image data is stored and called by the main CPU 100. For example, when image data is stored, image data scanned by the scanner section 4, image data as facsimile data supplied through the telephone line 404, and image data as print data supplied through the printer cable 402 are all stored in the image memory M in response to an instruction of the main CPU 100. The instruction from the main CPU 100 is executed in accordance with a mode determined by depressing a mode designation key of the control panel 200.

When an image is formed on paper based on image data stored in the image memory M in response to an instruction from the main CPU 100, the printer section 6 is capable of executing a single-sided image forming mode in which an image is formed on one side of paper and the paper is ejected and a double-sided image forming mode in which an image is formed on both sides of paper and the paper is ejected. These image forming modes can be set by depressing an icon displayed on the display panel 240.

When the single-sided image forming mode is selected, the main CPU 100 causes image data stored in the image memory M or image data scanned by the scanner section 4, image data as facsimile data supplied through the telephone line 404, and image data as print data supplied through the printer cable 402 to be output in predetermined page order. The main CPU 100 then drives the printer section 6 to form an image on a single side of each of paper sheets based on these image data and then eject the paper sheets in sequence.

When the double-sided image forming mode is selected, the main CPU 100 first causes image data stored in the image memory M or image data scanned by the scanner section 4, image data as facsimile data supplied through the telephone line 404, and image data as print data supplied through the printer cable 402 to be output in predetermined page order.

After that, the main CPU 100 supplies paper sheets of a given size from the multistage paper feeding unit 40 to the printer section 6 and drives the printer section 6 in which timing the paper sheets arrive at the printer section 6. First, the printer section 6 forms an image on one side or a first side of each paper sheet based on image data edited for one side of each paper sheet. Then, the main CPU 100 supplies the reversing mechanism 64 with the paper sheets with an image formed only on their first sides, and reverses them through the reversing path 66. The reversed paper sheets are stacked temporarily in the temporary stacking section 65.

If all the paper sheets with an image formed on each single side are stacked in the stacking section 65, they are picked up from the section 65 one by one and supplied again to the printer section 6.

After that, the printer section 6 forms an image on another side or a second side of each paper sheet based on image data edited for another side of each paper sheet. The main CPU 100 causes the paper sheets with an image formed on their both sides to be sequentially ejected and supplied to the finisher 59.

An image is so formed on the paper sheets supplied to the finisher 59 in predetermined order, e.g., in page order.

In the image forming apparatus described above, the copying function has an image reading mode for reading a document image to generate image data corresponding thereto and an image forming mode for forming an image on paper based on the image data.

In the image reading mode, when the main CPU 100 senses that documents are set on the document feeding table 72 of the automatic document feeding unit 8 in response to an output signal of the empty sensor 72*a*, the set documents are fed to a predetermined position of the document table 11 one by one in accordance with depression of the start button 210. The main CPU 100 drives the scanner section 4 to temporarily store image data corresponding to a document image in the image memory M. By doing so, image data corresponding to images of all documents set on the document feeding table 72 is stored temporarily in the image memory M.

In the image forming mode, the main CPU 100 first causes image data to be output from the image memory M in accordance with depression of the start button 210 and then drives the printer section 6 to form an image on paper based on the output image data. Thus, an image corresponding to all the image data stored in the image memory M is formed on the paper.

The image forming mode includes a single-sided image forming mode for forming an image on one side of paper and then ejecting the paper and a double-sided image forming mode for forming an image on both sides of paper and then ejecting the paper.

The double-sided image forming mode will now be described specifically, taking it as an example to form images on both sides of each of two paper sheets based on image data corresponding to document images of four pages.

Assume in the following that an image corresponding to the first page is a first image, an image corresponding to the second page is a second image, an image corresponding to the third page is a third image, an image corresponding to the fourth page is a fourth image, and two paper sheets serving as recording mediums on which image are to be formed or the first and second paper sheets each have a first side and a second side.

Figures 5A, 5B:
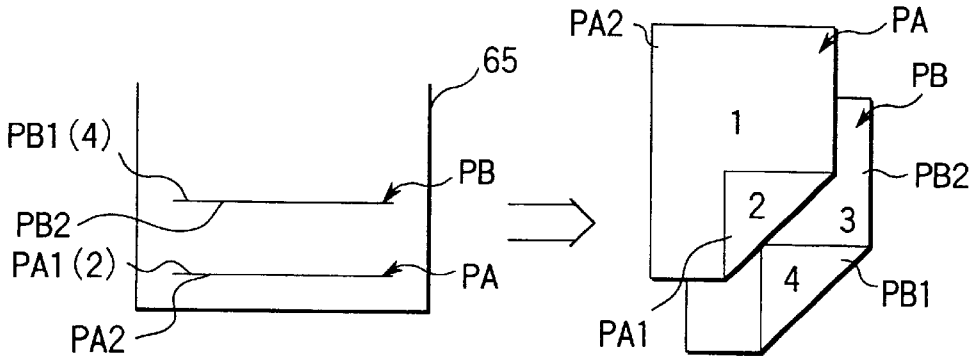
FIGS. 5A and 5B are views for explaining the states of paper sheets when a double-sided image forming mode of the image forming apparatus is normally executed.

FIGS. 5A and 5B are views for explaining the states of paper sheets when the double-sided image forming mode is normally executed.

In order to form an image on the first side of each of two paper sheets PA and PB, the first paper sheet PA is supplied to the printer section 6 such that its first side PA1 is opposed to the photosensitive drum 30. The main CPU 100 causes image data corresponding to the second image to be output from the image memory M, and drives the printer section 6 based on the image data to form the second image on the first side PA1 of the first paper sheet PA.

After that, the first paper sheet PA is guided to the reversing mechanism 64 and reversed through the reversing path 66, and the reversed paper sheet PA is stacked in the temporary stacking section 65.

The first paper sheet PA is stacked therein with its first side PA1 (on which the second image is formed) facing the pickup roller 67.

Subsequently the second paper sheet PB is supplied to the printer section 6 such that its first side PB1 is opposed to the photosensitive drum 30. The main CPU 100 causes image data corresponding to the fourth image to be output from the image memory M, and drives the printer section 6 based on the image data to form the fourth image on the first side PB1 of the second paper sheet PB.

After that, the second paper sheet PB is guided to the reversing mechanism 64 and reversed through the reversing path 66, and the reversed paper sheet PB is put on the first paper sheet PA stacked in the temporary stacking section 65. The second paper sheet PB is stacked therein, with its first side PB1 (on which the fourth image is formed) facing the pickup roller 67 and with its second side PB2 facing the first side PA1 of the first paper sheet PA.

The two paper sheets are thus stacked in the temporary stacking section 65 in such a manner that the second paper sheet PB is stacked on the first paper sheet PA as illustrated in FIG. 5A.

In order to form an image on the second side of each of two paper sheets PA and PB, the second paper sheet PB is picked up from the temporary stacking section 65 by the pickup roller 67, and then supplied to the printer section 6 such that its second side PB2 is opposed to the photosensitive drum 30. The main CPU 100 causes image data corresponding to the third image to be output from the image memory M, and drives the printer section 6 based on the image data to form the third image on the second side PB2 of the second paper sheet PB.

After that, the second paper sheet PB is ejected and supplied onto the ejection tray 59*b* of the finisher 59, with its second side PB2 (on which the third image is formed) upward and with its first side PB1 (on which the fourth image is formed) downward.

Subsequently, the first paper sheet PA is picked up from the temporary stacking section 65 by the pickup roller 67, and then supplied to the printer section 6 such that its second side PA2 is opposed to the photosensitive drum 30. The main CPU 100 causes image data corresponding to the first image to be output from the image memory M, and drives the printer section 6 based on the image data to form the first image on the second side PA2 of the first paper sheet PA.

After that, the first paper sheet PA is ejected and supplied onto the second paper sheet PB on the ejection tray 59*b* of the finisher 59, with its second side PA2 (on which the first image is formed) upward and with its first side PA1 (on which the second image is formed) facing the second side PB2 of the second paper sheet PB.

The two paper sheets are thus ejected in such a manner that the first paper sheet PA is put on the second paper sheet PB as illustrated in FIG. 5B. The first, second, third and fourth images can be formed on the second side PA2 of the first paper sheet PA, the first side PA1 thereof, the second side PB2 of the second paper sheet PB, and the first side PB1 thereof, respectively, in the order designated.

Accidents to be caused in the double-sided image forming mode will now be described.

Figures 6A, 6B:
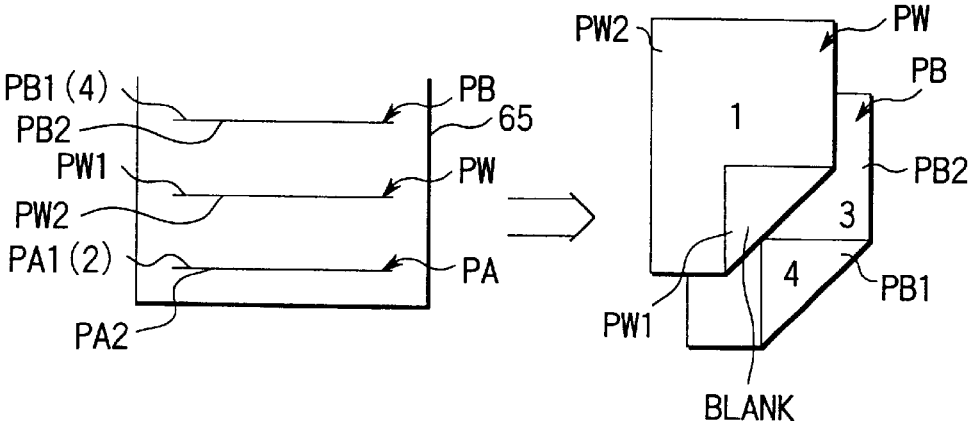
FIGS. 6A and 6B are views for explaining a first accident to be caused in the double-sided image forming mode.

FIGS. 6A and 6B are views for explaining a first accident to be caused in the double-sided image forming mode.

In the first accident, when the second paper sheet PB is supplied to the printer section 6, another paper sheet is supplied together therewith.

More specifically, in order to form an image on the first side of each of plural paper sheets, the first paper sheet PA is fed to the printer section 6 to form the second image on the first side PA of the first paper sheet PA. The first paper sheet PA is guided to the reversing mechanism 64 and reversed through the reversing path 66, and the reversed paper sheet PA is stacked in the temporary stacking section 65.

If, when the second paper sheet PB is fed to the printer section 6, another paper sheet PW is supplied together, the fourth image is formed only on the first side PB1 of the second paper sheet PB. The second paper sheet PB and the paper sheet PW are guided to the reversing mechanism 64 and reversed through the reversing path 66, and they are stacked in the temporary stacking section 65.

As shown in FIG. 6A, the paper sheet PW is stacked on the first paper sheet PA in the stacking section 65, and the second paper sheet PB is stacked on the paper sheet PW.

In order to form an image on the second side of each of these paper sheets, the second paper sheet PB is picked up from the stacking section 65 by the pickup roller 67 and supplied to the printer section 6. After that, the third image is formed on the second side PB2 of the second paper sheet PB, and the paper sheet PB is ejected and supplied onto the ejection tray 59*b* of the finisher 59.

Subsequently, the paper sheet PW is picked up from the stacking section 65 by the pickup roller 67 and fed to the printer section 6. After that, the first image is formed on the second side PW2 of the paper sheet PW, and the paper-sheet PW is ejected and supplied onto the second paper sheet PB stacked on the ejection tray 59*b*.

Needless to say, since no image is formed on the first side PW1 of the paper sheet PW, the paper sheet PW is ejected with the first side PW1 blank.

As illustrated in FIG. 6B, the second paper sheet PB and paper sheet PW are ejected with the latter sheet on the former sheet, the first image, blank image, third image and fourth image are formed in sequence on the second side PW2 of the paper sheet PW, the first side PW1 thereof, the second side PB2 of the second paper sheet PB, and the first side PB1 thereof, respectively.

Though two paper sheets are ejected, one paper sheet or the first paper sheet PA remains in the temporary stacking section 65.

Consequently, the double-sided image forming mode ends in failure.

Figures 7A, 7B:
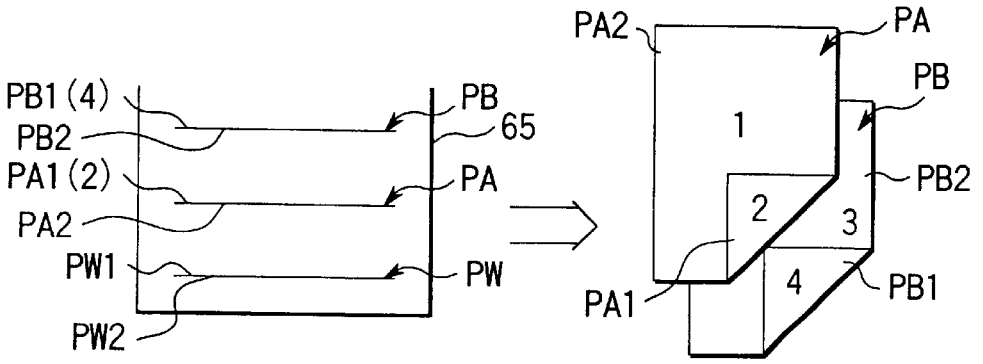
FIGS. 7A and 7B are views for explaining a second accident to be caused in the double-sided image forming mode.

FIGS. 7A and 7B are views for explaining a second accident to be caused in the double-sided image forming mode.

In the second accident, when the first paper sheet PA is supplied to the printer section 6, another paper sheet is supplied together therewith.

More specifically, in order to form an image on the first side of each of plural paper sheets, when the first paper sheet PA and another paper sheet PW are supplied to the printer section 6 together, the second image is formed on only the first side PA of the first paper sheet PA. The first paper sheet PA and paper sheet PW are guided to the reversing mechanism 64 and reversed through the reversing path 66, and they are stacked in the temporary stacking section 65. In this section 65, the first paper sheet PA is stacked on the paper sheet PW.

Subsequently, the second paper sheet PB is supplied to the printer section 6 and the fourth image is formed on only the first side PB1 of the second paper sheet PB. The second paper sheet PB is guided to the reversing mechanism 64 and reversed through the reversing path 66, and the reversed paper sheet is stacked in the temporary stacking section 65.

As illustrated in FIG. 7A, the first paper sheet PA is stacked on the paper sheet PW and the second paper sheet PB is stacked on the first paper sheet PA.

In order to form an image on the second side of each of these paper sheets, the second paper sheet PB is picked up from the stacking section 65 by the pickup roller 67 and supplied to the printer section 6. After that, the third image is formed on the second side PB2 of the second paper sheet PB, and the paper sheet PB is ejected and supplied onto the ejection tray 59*b* of the finisher 59.

Subsequently, the first paper sheet PA is picked up from the stacking section 65 by the pickup roller 67 and fed to the printer section 6. After that, the first image is formed on the second side PA2 of the first paper sheet PA, and the first paper sheet PA is ejected and supplied onto the second paper sheet PB astacked on the ejection tray 59*b*.

As illustrated in FIG. 7B, the first and second paper sheets PA and PB are ejected with the first paper sheet on the second paper sheet, the first, second, third, and fourth images are formed in sequence on the second side PA2 of the first paper sheet PA, the first side PA1 thereof, the second side PB2 of the second paper sheet PB, and the first side PB1 thereof, respectively.

Though two paper sheets are ejected, one paper sheet PW remains in the temporary stacking section 65.

The result of stacking onto the ejection tray 59*b* has success; however, one paper sheet remains in the section 65 and thus the double-sided image forming mode ends in failure.

Figure 8A:
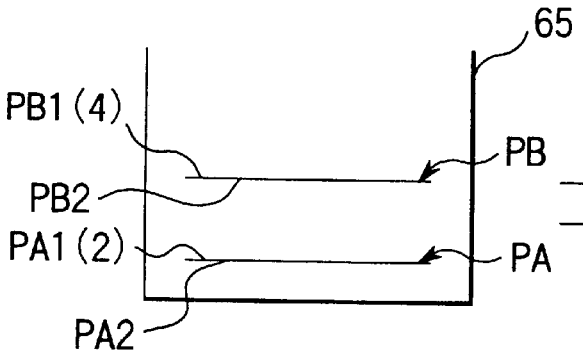
FIGS. 8A to 8C are views for explaining a third accident to be caused in the double-sided image forming mode.
Figure 8B:
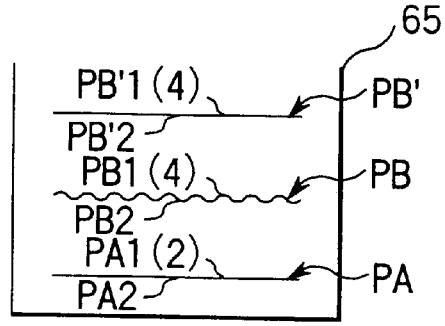
Figure 8C:
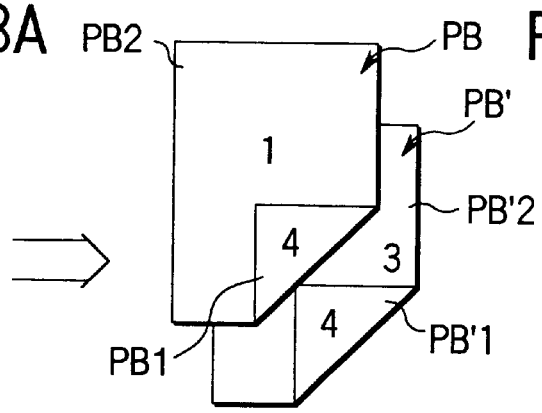

FIGS. 8A to 8C are views for explaining a third accident to be caused in the double-sided image forming mode.

The third accident is directed to a paper jam occurring when the second paper sheet PB is supplied from the temporary stacking section 65 to the printer section 6.

In order to form an image on the first side of each of plural paper sheets, the second image is formed on the first side PA1 of the first paper sheet PA and reversed, and the reversed paper sheet is stacked in the temporary stacking section 65. Then, the fourth image is formed on the first side PB1 of the second paper sheet PB and reversed, and the reversed paper sheet is stacked in the section 65.

As shown in FIG. 8A, in the section 65, the second paper sheet PB is stacked on the first paper sheet PA.

Subsequently, in order to form an image on the second side of each of these paper sheets, the second paper sheet PB is picked up from the stacking section 65 by the pickup roller 67 and supplied to the printer section 6. If a paper jam occurs during the supply of the sheet PB to the section 6, the second paper sheet PB is removed by a user, and stacked again on the first paper sheet PA in the stacking section 65 with its first side PB1 (on which the fourth image is formed) upward.

Since the main CPU 100 determines that the second paper sheet PB, which has caused the paper jam, is removed and thus not resupplied in the stacking section 65, it causes image data corresponding to the fourth image to be output from the image memory M and causes a new paper sheet PB' to be supplied to the printer section 6 to form the fourth image on the first side PB'1 of the sheet PB' based on the image data corresponding to the fourth image. After that, the main CPU 100 causes the paper sheet PB' to be reversed and stacked in the temporary stacking section 65.

By doing so, an operation of forming an image on the second side of the new paper sheet PB' is performed.

Since, however, the new paper sheet PB' is stacked in the stacking section 65, the second paper sheet PB, which has caused the paper jam, is stacked on the first paper sheet PA and the new paper sheet PB' is put on the second paper sheet PB.

In this state, the paper sheet PB' is picked up by the pickup roller 67 and supplied to the printer section 6 to form the third image on the second side PB'2 of the paper sheet PB', and the paper sheet PB' is ejected and supplied onto the ejection tray 59*b* of the finisher 59.

Subsequently, the second paper sheet PB is picked up from the stacking section 65 by the pickup roller 67 and fed to the printer section 6. The first image is formed on the second side PB2 of the second paper sheet PB, and the second paper sheet PB is ejected and supplied onto the paper sheet PB' put on the ejection tray 59*b*.

Consequently, as illustrated in FIG. 8C, the second paper sheet PB and paper sheet PB' are ejected together with the former sheet on the latter sheet, and the first, fourth, third, and fourth images are formed in sequence on the second side PB2 of the second paper sheet PB, the first side PB1 thereof, the second side PB'2 of the paper sheet PB', and the first side PB'1 thereof, respectively.

Though two paper sheets are ejected, one paper sheet or the first paper sheet PA remains in the temporary stacking section 65.

Consequently, the double-sided image forming mode ends in failure.

Figure 9A:
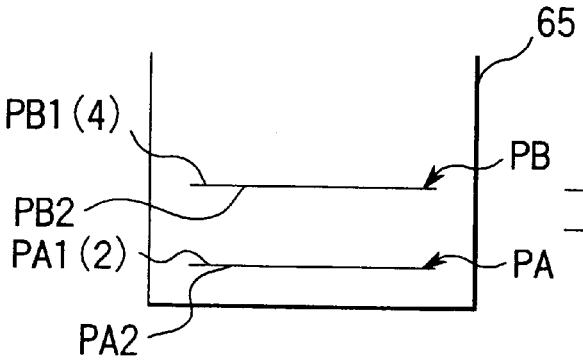
FIGS. 9A and 9B are views for explaining a fourth accident to be caused in the double-sided image forming mode.
Figure 9B:
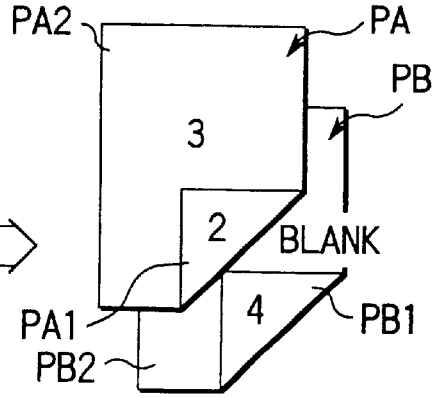

FIGS. 9A and 9B are views for explaining a fourth accident to be caused in the double-sided image forming mode.

In the fourth accident, when the second paper sheet PB is supplied from the temporary stacking section to the printer section 6, another paper sheet is supplied together therewith.

More specifically, in order to form an image on the first side of each of two paper sheets, the second image is formed on the first side PA1 of the first paper sheet PA, reversed and stacked in the temporal stacking section 65. Then, the fourth image is formed on the first side PB1 of the second paper sheet PB, reversed and stacked in the section 65.

As illustrated in FIG. 9A, the second paper sheet PB is stacked on the first paper sheet PA in the stacking section 65.

Subsequently, in order to form an image on the second side of each of the two paper sheets, the second paper sheet PB is picked up from the stacking section 65 by the pickup roller 67 and supplied to the printer section 6. If then the first paper sheet PA is supplied from the section 65, together with the second paper sheet PB, the third image is formed on only the second side PA2 of the first paper sheet PA, and the first and second paper sheets PA and PB are ejected and supplied onto the ejection tray 59*b* of the finisher 59. No image is formed on the second side PB2 of the second paper sheet PB.

As illustrated in FIG. 9B, the first and second paper sheets PA and PB are ejected with the former sheet on the latter sheet, the third image, second image, blank image and fourth image are formed in sequence on the second side PA2 of the first paper sheet PA, the first side PA1 thereof, the second side PB2 of the second paper sheet PB, and the first side PB1 thereof, respectively.

The main CPU 100 determines that only one paper sheet is ejected and the temporary stacking section 65 is empty; consequently, the double-sided image forming mode ends in failure.

A double-sided image forming mode, which can reliably be executed even when the above first to fourth accidents occur, will now be described.

Figure 10:
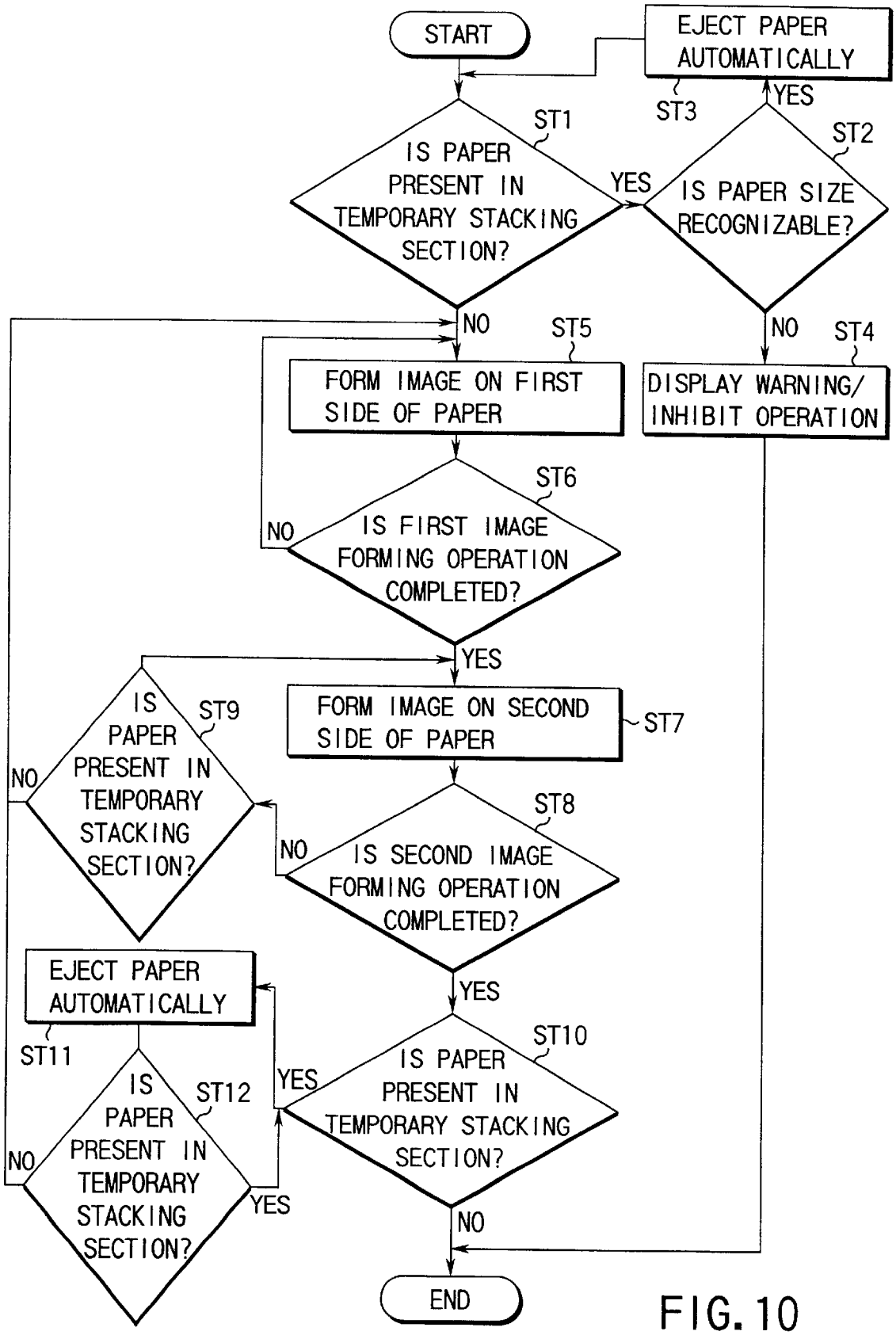
FIG. 10 is a flowchart for explaining a double-sided image forming mode applicable to the image forming apparatus of the present invention.

FIG. 10 is a flowchart showing a process of a double-sided image forming mode applied to the image forming apparatus of the present invention.

As shown in FIG. 10, the main CPU 100 first determines whether a paper sheet is present or not in the temporary stacking section 65 in response to an output signal of the sensor S provided in the reversing mechanism 64 (step ST1).

When the CPU 100 determines that a paper sheet is present in the stacking section 65 (step ST1, YES), it determines whether the size of the paper sheet can be recognized or not (step ST2).

When a paper sheet remains in the stacking section 65 in the image forming mode using the reversing mechanism 64, the main CPU 100 is capable of recognizing the size of the paper sheet used in the image forming mode. For this reason, the CPU 100 determines that the size of the paper sheet in the stacking section 65 can be recognized (step ST2, YES), and drives a motor for rotating various rollers to eject the paper sheet from the section 65 to the finisher 59 (step ST3). After that, in step ST1, the main CPU 100 determines again whether a paper sheet is present or not in the stacking section 65.

If a user manually replenishes the stacking section 65 with paper sheets or powers off the apparatus with the paper sheets in the section 65, the main CPU 100 has no information about the size of the paper sheets. The CPU 100 thus determines that the size cannot be recognized (step ST2, NO), and causes the display panel 240 to display a warning to remove the paper sheets from the section 65 and inhibits the apparatus from operating until the paper sheets are removed (step ST4). The double-sided image forming mode ends.

On the other hand, when the main CPU 100 determines that a paper sheet is not present in the stacking section 65 in response to the output signal of the sensor S (step ST1, NO), it causes an image to be formed on the first side of a paper sheet based on the first image data edited therefor (step ST5).

More specifically, in step ST5, a paper sheet is supplied to the printer section 6, the first image data is read out of the memory M, an image is formed on the first side of the paper sheet supplied to the printer section 6 based on the first image data, the paper sheet with the image formed on the first side thereof is reversed through the reversing path 66 of the reversing mechanism 64, and the reversed paper sheet is stacked in the temporary stacking section 65. Similarly, images are formed in sequence on the first sides of the paper sheets and the paper sheets are stacked in the stacking section 65.

After that, the main CPU 100 determines whether an operation of forming an image on the first side of the paper sheet based on the first image data (hereinafter referred to as a first image forming operation) is completed or not (step ST6). More specifically, the main CPU 100 determines whether the first image forming operation, which is performed on the basis of the last one of all the first image data read out of the image memory M, is completed or not, and repeats step ST5 until the first image forming operation is completed. If the CPU 100 determines that the first image forming operation is completed (step ST6, YES), it causes an image to be formed on the second side of a paper sheet based on the second image data edited therefor (step ST7).

In step ST7, a paper sheet is supplied from the stacking section 65 to the printer section 6, the second image data is read out of the image memory M, an image is formed on the second side of the paper sheet supplied to the printer section 6 based on the second image data, and ejected and supplied onto the ejection tray 59*b* of the finisher 59. Similarly, images are formed on the second sides of paper sheets based on the second image data, and the paper sheets are stacked on the ejection tray 59*b*.

After that, the main CPU 100 determines whether an operation of forming an image on the second side of the paper sheet based on the second image data (hereinafter referred to as a second image forming operation) is completed or not (step ST8). More specifically, the main CPU 100 determines whether the second image forming operation, which is performed on the basis of the last one of all the second image data, is completed or not.

If the CPU 100 determines that the second image forming operation is not completed (step ST8, NO), it determines whether a paper sheet remains in the temporary stacking section 65 in response to an output signal of the sensor S (step ST9).

If the main CPU 100 determines that a paper sheet remains in the stacking section 65 (step ST9, YES), it returns to step ST7 and continues the second image forming operation.

If, on the other hand, the CPU 100 determines that no paper sheet remains in the section 65 (step ST9, NO), it determines that the fourth accident as described above with reference to FIGS. 9A and 9B has occurred since the temporary stacking section 65 becomes empty and the paper sheets with an image formed their first sides run short though all the second image data is not output. After that, the main CPU 100 returns to step ST5 to execute the double-sided image forming mode again and start the first image forming operation.

When the CPU 100 determines that the second image forming operation (step ST8, YES), it determines whether a paper sheet is present in the temporary stacking section 65 in response to the output signal of the sensor S (step ST10).

If the main CPU 100 determines that a paper sheet remains in the stacking section 65 (step ST10 YES), it determines that the first to third accidents as shown in FIGS. 6A to 8C has occurred in the double-side image forming mode which has been just executed. Since then the CPU 100 recognizes the size of the paper sheet used in the double-sided image forming mode, it drives a motor for rotating various rollers to supply the paper sheets from the stacking section 65 to the finisher 59 (step ST11).

Thereafter, the main CPU 100 determines whether a paper sheet is present or not in the stacking section 65 in response to the output signal of the sensor S (step ST12). If the CPU 100 determines that a paper sheet remains in the stacking section 65 (step ST12, YES), it returns to step ST11 and drives the motor to eject the paper sheets from the stacking section 65 and supply them to the finisher 59.

If, after that, the main CPU 100 determines that all the paper sheets remaining in the stacking section 65 are ejected in response to the output signal of the sensor S (step ST12, NO), it returns to step ST5 to execute the double-sided image forming mode again and start the first image forming operation.

On the other hand, the main CPU 100 determines that the second image forming operation is completed (step ST8, YES) and that the temporary stacking section 65 becomes empty (step ST10, NO) in response to the output signal of the sensor S, it determines that the double-sided image forming mode is completed without any trouble and ends the double-side image forming mode in such a manner that it can receive the next image forming operation.

As described above, according to the image forming apparatus and the image forming method applied thereto, even though an accident incapable of arranging images on ejected paper sheets in predetermined order occurs in the image forming mode for forming an image on both sides of a recording medium such as a paper sheet having first and second sides, the main CPU 100 can determine that the accident has occurred.

More specifically, the main CPU 100 determines that an accident has occurred if paper sheets remain in the temporary stacking section when the double-sided image forming mode ends, and ejects all the paper sheets from the stacking section. After that, the main CPU executes the double-sided image forming mode again. If no paper sheets remain in the stacking section before the double-sided image forming mode ends, the main CPU 100 determines that an accident has occurred and immediately executes the double-sided image forming mode again.

By doing so, there can be provided an image forming apparatus capable of forming an image on both sides of a paper sheet in correct order and having a highly reliable double-sided image forming mode and an image forming method applied to the image forming apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming method comprising:

forming an image on one side of each of a plurality of recording mediums based on image data edited in predetermined output order;

temporarily stacking the plurality of recording mediums, each bearing the image on one side thereof, in a stacking section, the recording mediums being stacked in a reverse state;

forming an image on another side of each of the recording mediums stacked in the reverse state based on the image data in predetermined timing, and then ejecting the recording mediums outside; and ejecting a recording medium remaining in the stacking section outside when all images corresponding to the image data have been formed on the plurality of recording mediums; and executing a series of image forming operations again to both sides of each of the plurality of recording mediums based on the image data.

2. An image forming method comprising:

a first step of forming an image on one side of each of a plurality of recording mediums based on image data edited in predetermined output order, and temporarily stacking the plurality of recording mediums in a stacking section, the recording mediums being staked in a reverse state;

a second step of forming an image on another side of each of the recording mediums stacked in the reverse state based on the image data in predetermined timing, and ejecting the recording mediums outside; and a third step of executing the first step again in a case where no recording medium remains in the stacking section before all images corresponding to the image data are formed on the plurality of recording mediums.

3. An image forming method according to claim 2, further comprising a fourth step of ejecting a recording medium remaining in the stacking section outside when all images corresponding to the image data have been formed on the plurality of recording mediums.

4. An image forming method according to claim 3, further comprising a fifth step of executing the first step again after the fourth step is completed.

5. An image forming method according to claim 2, further comprising an ejecting step of ejecting a recording medium outside in a case where the recording medium is present in the stacking section before execution of the first step, and executing the first step in a case where no recording medium is present in the stacking section.

6. An image forming apparatus comprising:

image forming means for forming an image on a recording medium based on image data;

stacking means for temporarily stacking the recording medium in a reverse state, an image being formed on one side of the recording medium by the image forming means;

supplying means for supplying the recording medium stacked in the stacking means to the image forming means in predetermined timing;

sensing means for sensing whether the recording medium is present in the stacking means; and control means having a double-sided image forming mode in which the image forming means forms images corresponding to image data on first and second sides of each of a plurality of recording mediums, said control means executing the double-sided image forming mode once again in a case where the sensing means senses that no recording medium remains in the stacking means before all the images corresponding to the image data are formed on the recording mediums stacked in the stacking means in the double-sided image forming mode.

7. An image forming apparatus according to claim 6, which further comprises ejecting means for ejecting the recording mediums outside, and in which the control means causes the ejecting means to eject the recording mediums outside in a case where the sensing means senses that the recording mediums remain in the stacking means when all images corresponding to the image data have been formed on the plurality of recording mediums stacked in the stacking means.

8. An image forming apparatus according to claim 7, wherein the control means causes the ejecting means to eject all recording mediums from the stacking means and then executes the double-sided image forming mode.

9. An image forming apparatus according to claim 7, wherein the control means determines whether a recording medium is present in the stacking means in response to a sensing result of the sensing means before the double-sided image forming mode is executed, and causes the ejecting means to eject a recording medium outside when the recording medium is present in the stacking means and executes the double-sided image forming mode when no recording medium is present in the stacking means.

10. An image forming apparatus comprising:

image formation means for forming an image on recording mediums based on image data;

stacking means for temporarily stacking the recording mediums, each bearing the image formed on one side thereof by the image formation means, the recording mediums being stacked in a reverse state;

supplying means for supplying the recording mediums stacked in the stacking means to the image formation means in predetermined timing;

sensing means for sensing whether a recording medium is present in said stacking means;

ejecting means for ejecting the recording mediums outside; and control means having a double-sided image forming mode in which the image forming means forms images corresponding to image data on first and second sides of each of a plurality of recording mediums, said control means controlling the ejecting means to eject a recording medium outside in a case where the sensing means senses that the recording medium is present in the stacking means when all images corresponding to the image data have been formed on the plurality of recording mediums stacked in the stacking means in the double-sided image forming mode, and controlling the image forming means to form images again corresponding to the same image data as that applied in the double-side image forming mode.

* * * * *